US006091434A

United States Patent [19]

Sousa

[11] Patent Number: 6,091,434

[45] Date of Patent: Jul. 18, 2000

[54] METHOD OF CALIBRATING DISTANCES BETWEEN IMAGING DEVICES AND A ROTATING DRUM

[75] Inventor: John Gary Sousa, Hudson, N.H.

[73] Assignee: Presstek, Inc., Hudson, N.H.

[21] Appl. No.: 09/069,692

[22] Filed: Apr. 29, 1998

[51] Int. Cl.[7] ..... B41J 2/39

[52] U.S. Cl. ..... 347/149; 347/258

[58] Field of Search ..... 347/149, 255, 347/256, 257, 258, 238, 241, 242

[56] References Cited

U.S. PATENT DOCUMENTS

| | | | |
|---|---|---|---|
| 4,875,057 | 10/1989 | Hediger et al. | 347/242 |
| 5,225,855 | 7/1993 | Hansen et al. | 347/149 |
| 5,764,274 | 6/1998 | Sousa et al. | 347/258 |

*Primary Examiner*—Arthur T. Grimley
*Assistant Examiner*—Hoan Tran
*Attorney, Agent, or Firm*—Cesari & McKenna

[57] ABSTRACT

Optimization of distances between each of an array of imaging devices and the surface of an oppositely disposed rotating drum is accomplished without disturbing the mechanical mounting of the imaging devices. For each device, an optimal distance from the recording construction is established; at this optimal distance, corresponding to substantially proper focus, maximum energy density is delivered to a recording medium on the drum. Rather than alter the actual device-to-drum distance to conform to this optimum, the optical paths between the devices and the drum are changed by varying the spacing between the radiation source (e.g., the end of a fiber-optic cable) and the assembly. This alters the point of focus, and therefore has the same practical effect as moving the device itself. The invention also provides a technique for determining the optimal device-to-drum distance by means of a sequence of imaged regions applied at different device-to-drum distances.

8 Claims, 4 Drawing Sheets

METHOD OF CALIBRATING DISTANCES BETWEEN IMAGING DEVICES AND A ROTATING DRUM

BACKGROUND OF THE INVENTION

1. Field of the Invention

The present invention relates to digital imaging apparatus and methods, and more particularly to a system for imaging recording constructions (such as lithographic printing members) using digitally controlled laser output.

2. Description of the Related Art

Numerous industrial and graphic-arts applications require pinpoint delivery of laser radiation to the surface of a rotating drum. Such applications include, for example, copying, printing and proofing applications in which the radiation is used to expose a recording member. By rotating the drum while drawing the laser source in an axial direction, a complete scan of the recording construction is achieved. During the course of the scan, the laser source is activated in an imagewise fashion to produce a series of image dots at appropriate locations on the recording member. Depending on the system, the image dots may alter the recording member directly or in a latent sense, requiring subsequent development.

For example, U.S. Pat. Nos. 5,351,617 and 5,385,092 disclose ablative recording systems that use low-power laser discharges to remove, in an imagewise pattern, one or more layers of a lithographic printing blank, thereby creating a ready-to-ink printing member without the need for photographic development. In accordance with those systems, laser output is guided from a laser diode to the printing surface and focused onto that surface (or, desirably, onto the layer most susceptible to laser ablation, which will generally lie beneath the surface layer). Other systems use laser energy to cause transfer of material from a donor to an acceptor sheet, to record non-ablatively, or as a pointwise alternative to overall exposure through a photomask or negative.

As discussed in the '617 and '092 patents, laser output can be generated remotely and brought to the recording blank by means of optical fibers and focusing lens assemblies. Commercial systems typically employ an array (usually, but not necessarily linear) of lasers and associated focusing assemblies in order to reduce overall imaging time. Each assembly images over a circumferential band, the width of which defines the total axial movement of the array during the course of scanning.

A representative system is illustrated in FIGS. 1A and 1B. The system includes a cylinder 100 around which is wrapped a lithographic plate blank 102. Cylinder 100 includes a void segment 105, within which the outside margins of plate 102 are secured by conventional clamping means (not shown). Cylinder 100 is supported in a frame and rotated by a standard electric motor or other conventional means. The angular position of cylinder 100 is monitored by a shaft encoder 108. A writing array 110, mounted for movement on a lead screw 112 and a guide bar 115 (see FIG. 1B), traverses plate 102 as it rotates. Axial movement of writing array 110 results from rotation of a stepper motor 118, which turns lead screw 112 and thereby shifts the axial position of writing array 110. Stepper motor 118 is activated during the time writing array 110 is positioned over void 105, i.e., after writing array 110 has passed over the entire surface of plate 102. The rotation of stepper motor 118 shifts writing array 110 to the appropriate axial location to begin the next imaging pass.

The axial index distance between successive imaging passes is determined by the number of imaging elements in writing array 110 and their configuration therein, as well as by the desired resolution. The imaging elements may be a series of independently addressable diode lasers whose outputs are conducted to associated focusing assemblies 120. These are evenly distributed along the linear writing array 110. The interior of writing array 110, or some portion thereof, contains threads that engage lead screw 112, rotation of which advances writing array 110 along plate 102 as discussed previously.

With reference to FIG. 2, the imaging radiation that strikes plate 102 originates with a series of laser sources, one of which is representatively indicated at 200. The output of laser 200 is guided, by means of a fiber-optic cable 205, to an associated focusing assembly 120. Laser 200 is selectably switched on and off by one of a series of laser drivers 210. A controller 215 operates laser drivers 210 to produce imaging bursts when the various focusing assemblies 120 reach appropriate points opposite plate 102.

Controller 215 receives data from two sources. The angular position of cylinder 100 with respect to the laser output is constantly monitored by shaft encoder 108, which provides signals indicative of that position to controller 215. In addition, an image data source (e.g., a computer) 220 also provides data signals to controller 215. The image data define points on the plate 102 where image spots are to be written. Controller 215, therefore, correlates the instantaneous relative positions of focusing assemblies 120 and plate 102 (as reported by encoder 108) with the image data to actuate the appropriate laser drivers at the appropriate times during scan of plate 102.

Assembly 120 contains a focusing lens that focuses radiation from cable 205 onto the surface of plate 102, concentrating the entire laser output onto plate 102 as a small feature to achieve high effective energy densities. The distance S between the output lens of focusing assembly 120 and the surface of plate 102 is chosen so that the beam is precisely focused on the surface, as indicated in FIG. 2.

Actually conforming all of the focusing assemblies 120 to this ideal, however, is very difficult as a realistic matter. Even slight differences among assemblies 120 in terms of the distance S can affect imaging performance. This is because any deviation from perfect focus results in lost energy density, since by definition the point of perfect focus is where power is most highly concentrated. Slight skew or yaw of the writing head 110 with respect cylinder 100, or differences in the mounting configurations for the focusing assemblies within writing head 110, can result in different effective laser energy densities reaching the plate 102. In printing applications, this translates into different exposure densities at the plate, and consequent printing-density variations on the final copy.

DESCRIPTION OF THE INVENTION

Brief Summary of the Invention

In accordance with the present invention, the distance S is individually optimized for each focusing assembly in a multi-beam writing head. This may be accomplished without disturbing the mounting of the focusing assemblies themselves; that is, correction in accordance with the invention can take place after the focusing assemblies are mounted and without affecting the mechanical integrity of the mount.

The invention facilitates optimization of distances between each of an array of imaging devices and the surface of an oppositely disposed rotating drum. The devices comprise output lens assemblies through which radiation from an associated laser is focused. In accordance with a first aspect of the invention, the devices are focusing assemblies that receive laser radiation by means of a fiber-optic cable removably connected to the assembly. For each device, an optimal distance from the recording construction is established; at this optimal distance, corresponding to substantially proper focus, maximum energy density is delivered to a recording medium on the drum. Because the device mountings are not disturbed, however, the distances between the devices and the drum represent a fixed mechanical property of the system. Rather than alter this distance, the optical path between a device and the drum is changed by varying the spacing between the fiber-optic cable and the assembly. This alters the point of focus, and therefore has the same practical effect as moving the device itself. The relationship between alteration of this spacing and the resulting effect on the point of focus depends on the demagnification ratio of the focusing lens. Proper spacing adjustment focuses radiation directly on the recording medium.

In a second aspect, the invention provides a technique for determining the optimal distance between the individual devices and the recording drum. Actually obtaining this distance may be accomplished by varying the spacing between the device and a fiber-optic cable, as described above; or the device-to-drum distance may be directly altered by mechanical intervention. This approach is particularly well-suited to lasers having multimode outputs that are difficult to characterize using standard beam analyzers.

In accordance with this aspect of the invention, the devices to be adjusted are operated at a default array-to-drum distance to image a patch on a recording construction affixed to the drum. These patches are substantially collinear along a first dimension (preferably the axial dimension along the drum). Additional rows of patches are applied along a second dimension (preferably the circumferential direction around the drum) at different array-to-drum spacings. This effectively produces a map of patches for the various devices, and for each device, the map is used to locate the distance corresponding to maximum energy density—that is, to proper focus.

BRIEF DESCRIPTION OF THE DRAWINGS

The foregoing discussion will be understood more readily from the following detailed description of the invention, when taken in conjunction with the accompanying drawings, in which.

DETAILED DESCRIPTION OF THE PREFERRED EMBODIMENTS

Figure 1A:
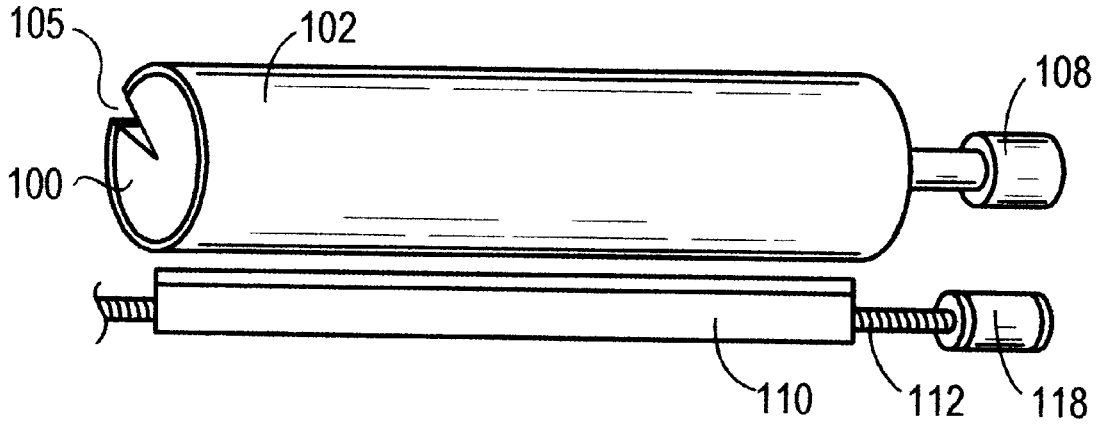
FIG. 1A (PRIOR ART)
FIG. 1A is an isometric view of an imaging apparatus that operates in conjunction with a linear-array writing array.
Figure 1B:
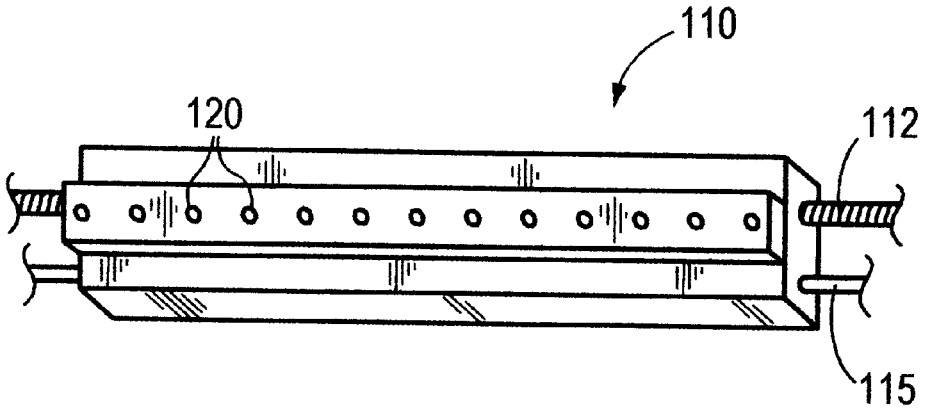
FIG. 1B (PRIOR ART)
FIG. 1B is an isometric view of the front of a writing array for imaging in accordance with the present invention, and in which imaging elements are arranged in a linear fashion.
Figure 3:
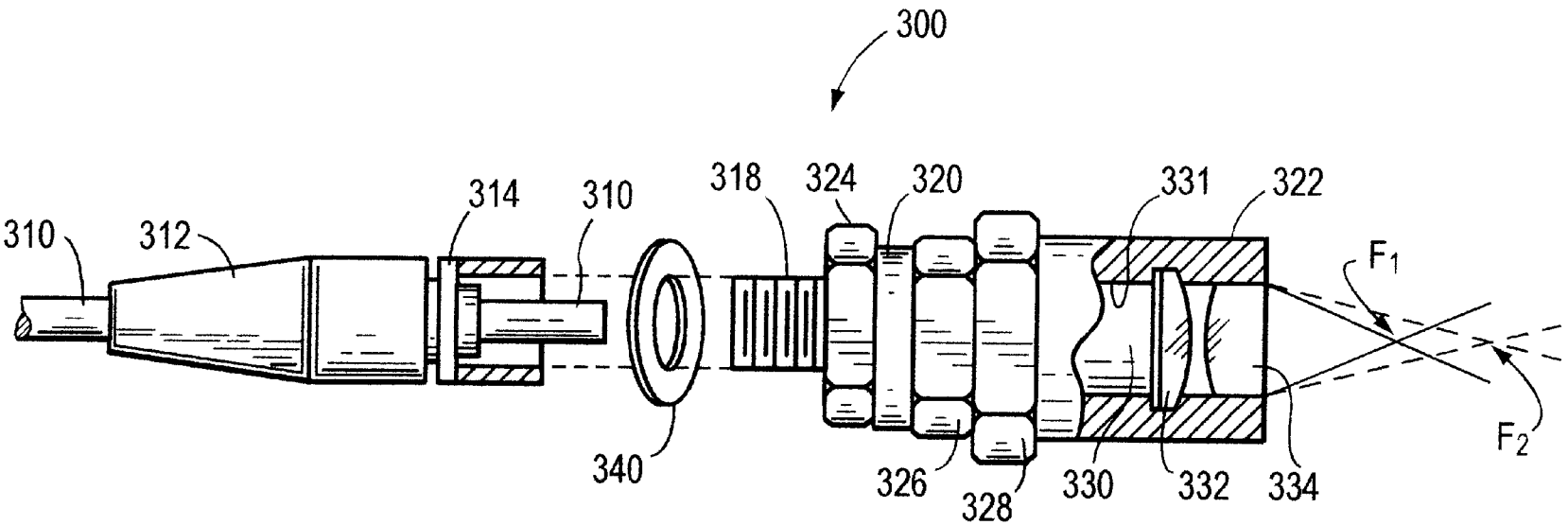
FIG. 3 is a partial cutaway elevation of a focusing device to which the present invention may be applied.

Refer to FIG. 3, which illustrates a representative focusing assembly 300 (which may serve as one of the focusing devices 120 shown in FIG. 1B). Laser output is provided by a fiber-optic cable 310 terminating in an SMA (or similar) connector package 312, which includes a threaded collar 314 that is free to rotate. The focusing assembly 300 includes a threaded stem 318 that mates with collar 314; a first tubular housing segment 320; and a second housing segment 322. Stem 318 is secured to segment 320 by a nut 324. The central axis of stem 318 passes through segments 320, 322 to define a single continuous bore 330 with an inner wall 331. Segments 320 and 322 are locked by a pair of nuts 326, 328. Segment 322 contains a pair of focusing lenses 332, 334 at its terminus; alternatively, depending on design, a single focusing lens may suffice.

Also, the inner end of segment 320 desirably terminates in a baffle (not shown) that defines an aperture, thereby imposing a fixed radial extent by which emitted radiation can diverge from the central propagated ray. This prevents passage of radiation having NA values above a predetermined limit. The baffle may have a sharp, flared edge (such as a conically flared bezel) to avoid reflections.

With collar 314 of SMA connector 312 screwed fully onto stem 318, radiation emitted from the end face of fiber 310 is focused onto a point $F_1$. Accordingly, unless a recording construction is disposed precisely at $F_1$ during imaging, the image spot will not be focused thereon and, as a result, the energy density reaching the recording construction will be less than the available maximum. By disposing a spacing shim 340 between collar 314 and nut 324, however, the distance between the end face of cable 310 and lenses 332, 334 is increased; as a result, the point of focus moves from $F_1$ to $F_2$. Accordingly, it is possible to displace the point of focus by a desired amount through a properly chosen spacing extension at the connection between the fiber-optic cable (or, depending on the system, a diode laser that directly connects in a similar fashion) and the focusing assembly.

The proper amount of spacing—i.e., the number of shims 340—is dictated by the demagnification ratio $r_m$ of the focusing lenses. That ratio, in turn, relates the focused image distance $s_i$ to the distance $s_s$ between the source and the lenses, i.e., $r_m=s_i/s_s$. Thus, to achieve a forward displacement d of the focused distance, it is necessary to use one or more shims 340 of total thickness $d/r_m$.

Depending on the type of beam involved, it may be possible to locate the point of focus for a given assembly using a conventional beam analyzer. With collar 314 screwed fully over stem 318 (i.e., without a spacer 340), the analyzer is moved toward and away from lens 334 until the point of maximum energy density is recorded. As noted previously, however, multimode beams can be difficult to characterize with a beam analyzer. In such cases, a different approach to determining the point of focus is necessary.

Figure 4:
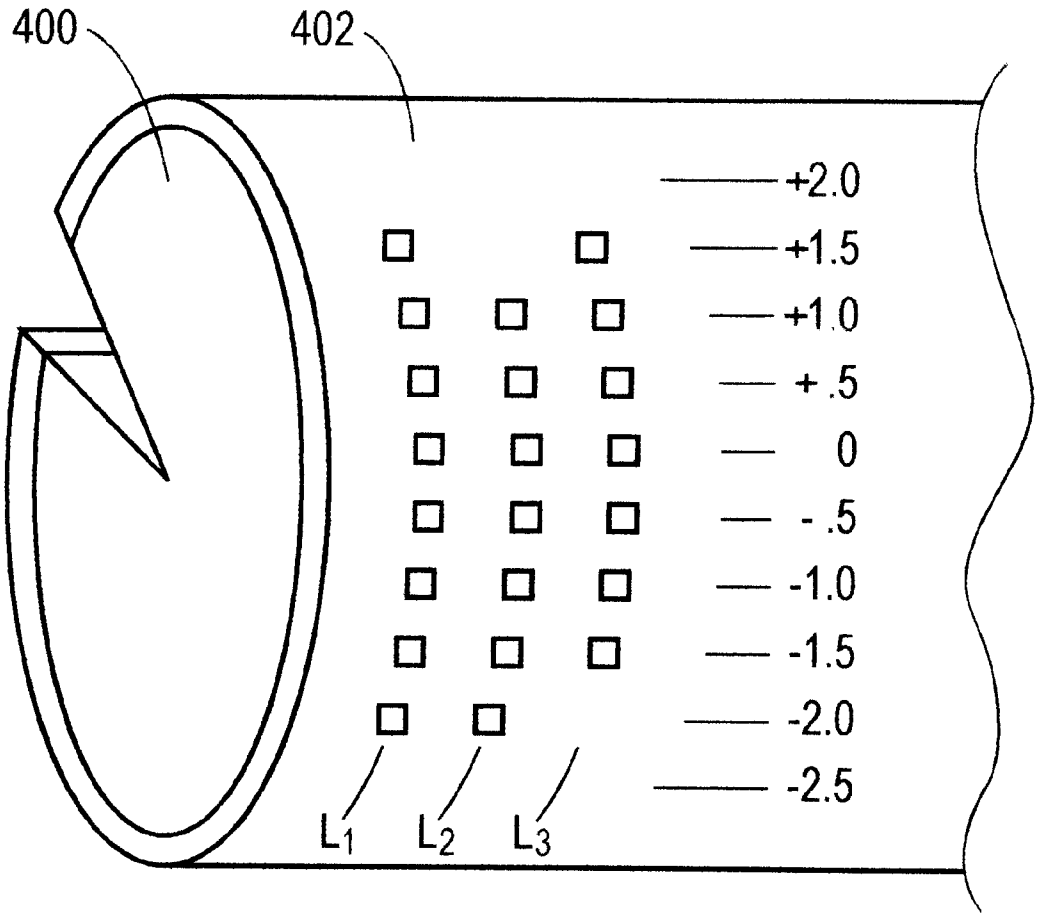
FIG. 4 schematically illustrates determination of optimal device-to-drum distances in accordance with the invention.

Such an approach is illustrated in FIG. 4. A rotatable drum or cylinder 400 bears a recording construction 402 sensitive to the imaging output of a laser (or other optical source). The recording construction may be a printing plate, proofing sheet, or any other construction capable of recording in response to imaging radiation. It may be mounted to cylinder 400 or may instead be integral with the cylinder.

Figure 2:
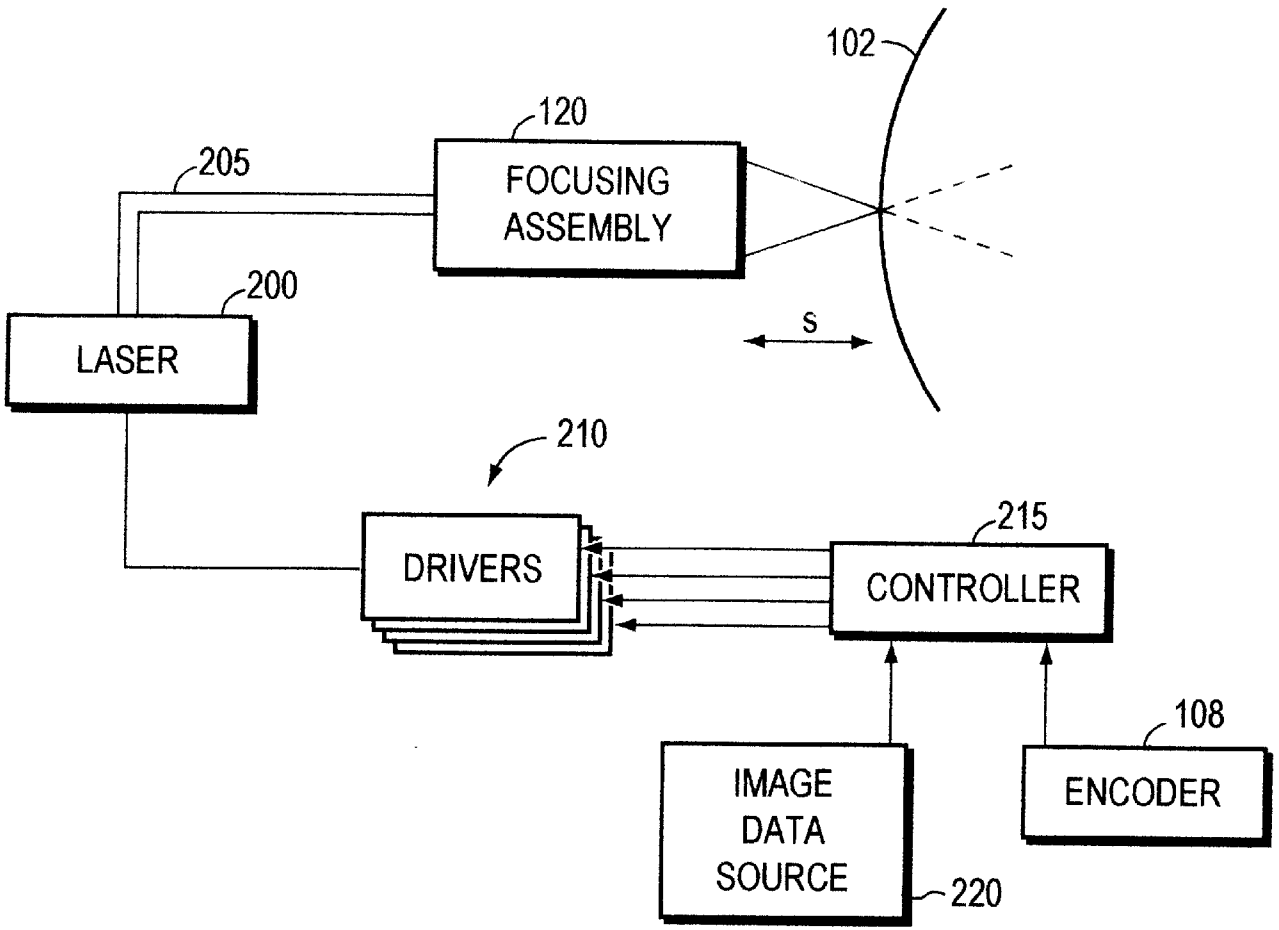
FIG. 2 (PRIOR ART)
FIG. 2 schematically illustrates the basic components of a representative environment for the invention.

Cylinder 400 is rotated and controller 215 (see FIG. 2) operated to cause each imaging device for which radial alignment is desired—generally all devices in an array—to image a patch on construction 402. The result is an axial row of patches at the default distance (i.e., the normal working distance between cylinder 400 and the array of imaging devices, and therefore labeled 0). The distance between cylinder 400 and the device array is then altered by a fixed increment and the process repeated, with the new row of patches circumferentially displaced from the previously applied row. Generally, the array-to-cylinder distance is altered through movement of cylinder 400, but the imaging array may be moved instead (or in addition). Additional rows of patches at further array-to-cylinder distance increments are applied to the recording construction 402 until the last device under examination fails perceptibly to affect the recording construction; that is, until the focus has degraded to the point that imaging no longer occurs.

At this point, the recording construction contains a pattern of patches, the rows of which correspond to particular array-to-cylinder distances (each differing by a fixed increment, i.e., 0.5 mil in the illustration), and the circumferential columns of which correspond to the imaging devices $L_1$, $L_2$, $L_3$, etc. For each device (i.e., each column), the patch having a maximum exposure density may be identified as the midpoint of the visible patches—that is, the patch lying at the midpoint between the non-imaging patches.

Preferably, the array-to-cylinder distance increments are chosen to correspond to the thickness of a single shim 340 (taking into account the demagnification ratio), and are desirably sufficiently small that deviation by a single increment will not substantially affect imaging performance. The maximum desirable increment, then, depends on the depth-of-focus of the imaging devices. If this parameter is not taken into account and too large an increment is chosen, the optimal array-to-cylinder distance may lie between increments, with the consequence that the devices will not be optimally adjusted for distance and will image at different effective energy densities resulting in visible differences (e.g., if the construction 402 is a printing plate, in the printed copy). Moreover, a fine increment amount allows for arbitrary choice where an even number of patches lie between non-imaging patches.

Thus, for device $L_1$, eight patches appear, and the distance to proper focus lies between 0 (the default distance reflecting no adjustment) and −0.5 (i.e., 0.5 mil closer to the imaging device). So long as the increment is sufficiently small, the choice of distance adjustment (i.e., no adjustment vs. an adjustment leading to a −0.5 mil displacement) will not matter. For device $L_2$, an adjustment leading to a displacement of −0.5 mil is clearly warranted. And for device $L_3$, no adjustment is needed.

It should be stressed that this technique of determining optimal array-to-cylinder distances is useful in conjunction with any approach to adjusting the focused distance of the imaging devices, whether or not this involves the use of shims. If shims are used, however, it is preferred to employ focusing lenses that require a plurality of shims to achieve the default (no adjustment) distance. In this way, shims can be removed or added, thereby facilitating positive or negative adjustment to the default distance.

It will therefore be seen that the foregoing approaches to calibrating distances between imaging devices and a rotating drum are both reliable and conveniently practiced. The terms and expressions employed herein are used as terms of description and not of limitation, and there is no intention, in the use of such terms and expressions, of excluding any equivalents of the features shown and described or portions thereof, but it is recognized that various modifications are possible within the scope of the invention claimed.

What is claimed is:

1. A method of optimizing distances between each of an array of imaging devices disposed opposite a rotating drum and configured to apply an imaging output onto a recording construction carried on the drum, the devices comprising output lens assemblies through which radiation from an associated laser is focused onto the recording construction, the method comprising the steps of:

a. at a first distance between the array and the recording construction, causing at least some of the devices to apply a patch on the recording construction by means of the laser radiation, the patches being substantially collinear along a first dimension;

b. establishing an altered distance between the array and the recording construction;

c. at the altered distance, causing at least some of the devices to apply a patch on the recording construction by means of the laser radiation, the patches being substantially collinear along the first dimension, the patches applied at the first distance and at the altered distance being substantially collinear along a second dimension distinct from the first dimension;

d. repeating step (c) at least once, the patches applied at each altered distance being substantially collinear along the second dimension;

e. for the patches produced by an imaging device along the second dimension, locating a patch corresponding to a highest laser-radiation energy density on the recording construction; and f. individually fixing each imaging device at a distance from the recording construction corresponding to the distance producing thereon the highest energy density for the device.

2. The method of claim 1 wherein the devices each comprise output lens assemblies through which radiation from a laser connected thereto is focused.

3. The method of claim 2 wherein each of the devices receives laser radiation by means of a fiber-optic cable removably connected to the assembly, the fixing step comprising altering a distance between the fiber-optic cable and the assembly.

4. The method of claim 3 wherein the connection is established by a connector associated with the fiber-optic cable and removably affixable to the assembly, the distance being altered by imposition of at least one shim between the connector and the assembly.

5. The method of claim 1 wherein the patch having a maximum energy density is located by repeating step (c) such that, for each device, the patches along the second dimension form a series that begins and ends with a non-imaging patch, the patch corresponding to the highest laser-radiation energy density on the recording construction lying at a midpoint between the non-imaging patches.

6. A method of optimizing distances between each of an array of imaging devices disposed opposite a rotating drum at a default distance therefrom and configured to apply an imaging output onto a recording construction carried on the drum, the devices (i) comprising output lens assemblies through which radiation from an associated laser is focused onto the recording construction and (ii) receiving laser radiation by means of a fiber-optic cable removably connected to the assembly, the method comprising the steps of:

a. determining, for each device, an optimal distance from the recording construction, the device producing a highest energy density on the recording construction at the optimal distance; and b. for each device for which the optimal distance deviates from the default distance, altering a distance between the fiber-optic cable and the assembly corresponding to the amount of deviation.

7. The method of claim 6 wherein the connection is established by a connector associated with the fiber-optic cable and removably affixable to the assembly, the distance being altered by imposition of at least one shim between the connector and the assembly.

8. The method of claim 6 wherein the output lens assemblies focus radiation onto the recording construction at a demagnification ratio, said ratio determining the distance between the fiber-optic cable and the assembly corresponding to the amount of deviation between the optimal distance and the default distance.

* * * * *